US005887495A

United States Patent [19]

Kao

[11] Patent Number: 5,887,495

[45] Date of Patent: Mar. 30, 1999

[54] PLIERS

[76] Inventor: Hung-Tien Kao, 58, Ma Yuan West St., Taichung, Taiwan

[21] Appl. No.: 958,148

[22] Filed: Oct. 24, 1997

[51] Int. Cl.[6] ..... B25B 7/12

[52] U.S. Cl. ..... 81/358; 81/359; 81/360

[58] Field of Search ..... 81/355, 358, 359, 81/360, 366, 393, 405, 407, 409, 409.5, 411, 413

[56] References Cited

U.S. PATENT DOCUMENTS

| | | | |
|---|---|---|---|
| 1,048,298 | 12/1912 | Daniels | 81/359 |
| 3,109,333 | 11/1963 | Anderson | 81/358 |
| 3,210,844 | 10/1965 | Tontscheff | 81/358 |
| 5,140,876 | 8/1992 | Field | 81/408 |
| 5,351,584 | 10/1994 | Warheit | 81/407 |
| 5,408,904 | 4/1995 | Neff | 81/360 |

*Primary Examiner*—David A. Scherbel
*Assistant Examiner*—Sinclair Skinner

[57] ABSTRACT

A pair of pliers has a driving handle, a fixed handle, a block plate, a U-shaped spring, a first torsion spring, and a second torsion spring. The driving handle couples with the fixed handle pivotally. The first torsion spring and the second torsion spring are connected to the driving handle and the fixed handle. The U-shaped spring is connected to the driving handle and the fixed handle.

2 Claims, 3 Drawing Sheets

PLIERS

BACKGROUND OF THE INVENTION

The invention relates to a pair of pliers. More particularly, the invention relates to a pair of pliers which is easily operated.

A pair of conventional pliers has a right handle, a left handle, a stub connected to two handles, and a pivot at the intersection of two handles. At least a spring is disposed on the right handle. A block on the right handle blocks the stub. A sliding slot with ratchet teeth receives a pawl. However, the user has to squeeze and release the handles continuously in order to adjust the width of the jaws. Since there is a space between two ratchet tooth, the width of an article between two jaws may not just fit the width of the jaws.

SUMMARY OF THE INVENTION

An object of the invention is to provide a pair of pliers which can be easily operated.

Another object of the invention is to provide a pair of pliers which can clamp an article tightly.

Another object of the invention is to provide a pair of pliers which can adjust the width of the nest steplessly.

Accordingly, a pair of pliers comprises a driving handle, a fixed handle, a block plate, a U-shaped spring, a first torsion spring, and a second torsion spring. The driving handle couples with the fixed handle pivotally. The first torsion spring and the second torsion spring are connected to the driving handle and the fixed handle. The U-shaped spring is connected to the driving handle and the fixed handle.

In accordance with a preferred embodiment, a pair of pliers comprises a driving handle, a fixed handle, a block plate, a U-shaped spring, a first torsion rod spring, and a second torsion rod spring. The driving handle has a first front jaw, first serrated teeth formed on an inner lateral of the first front jaw, a first rear grip portion, a first lever portion between the first front jaw and the first rear grip portion, an oblong hole formed on the first lever portion, a plurality of serrations formed in the oblong hole, a round through hole formed on the first rear grip portion, a first recess slot formed on the first rear grip portion, and a second recess slot formed on the first rear grip portion. The fixed handle has a second front jaw, a second serrated teeth formed on an inner lateral of the second front jaw, a second rear grip portion, a second lever portion between the second front jaw and the second rear grip portion, a circular hole formed on the second lever portion, a first circular through hole formed on the second rear grip portion, a second circular through hole formed on the second rear grip portion, and a curved recess slot formed on the second rear grip portion. The first torsion rod spring has a first distal end and a second distal end. The first distal end matches the round through hole. The second distal end matches the first circular through hole. The second torsion rod spring has a third distal end and a fourth distal end. The third distal end matches the round through hole. The fourth distal end matches the first circular through hole. The U-shaped spring has a first arm, a second arm, and a link portion between the first arm and the second arm. The first arm has a first torsion spring end. The second arm has a second torsion spring end. The link portion is inserted in the second recess slot. The first torsion spring end and the second torsion spring end matches the second circular through hole. The block plate has two teeth, a round hole, an aperture, and a camber portion. The block plate is inserted in the oblong hole. A compression spring and a post are inserted in the aperture. The round hole matches the circular hole. A bolt passes through the circular hole, the round hole, a cushion, and a nut. A first pin passes through the round through hole, the first distal end, and the third distal end. A second pin passes through the first circular through hole, the second distal end and the fourth distal end. The third pin passes through the second circular through hole, the first torsion spring end, and the second torsion spring end.

DETAILED DESCRIPTION OF THE INVENTION

Figure 1:
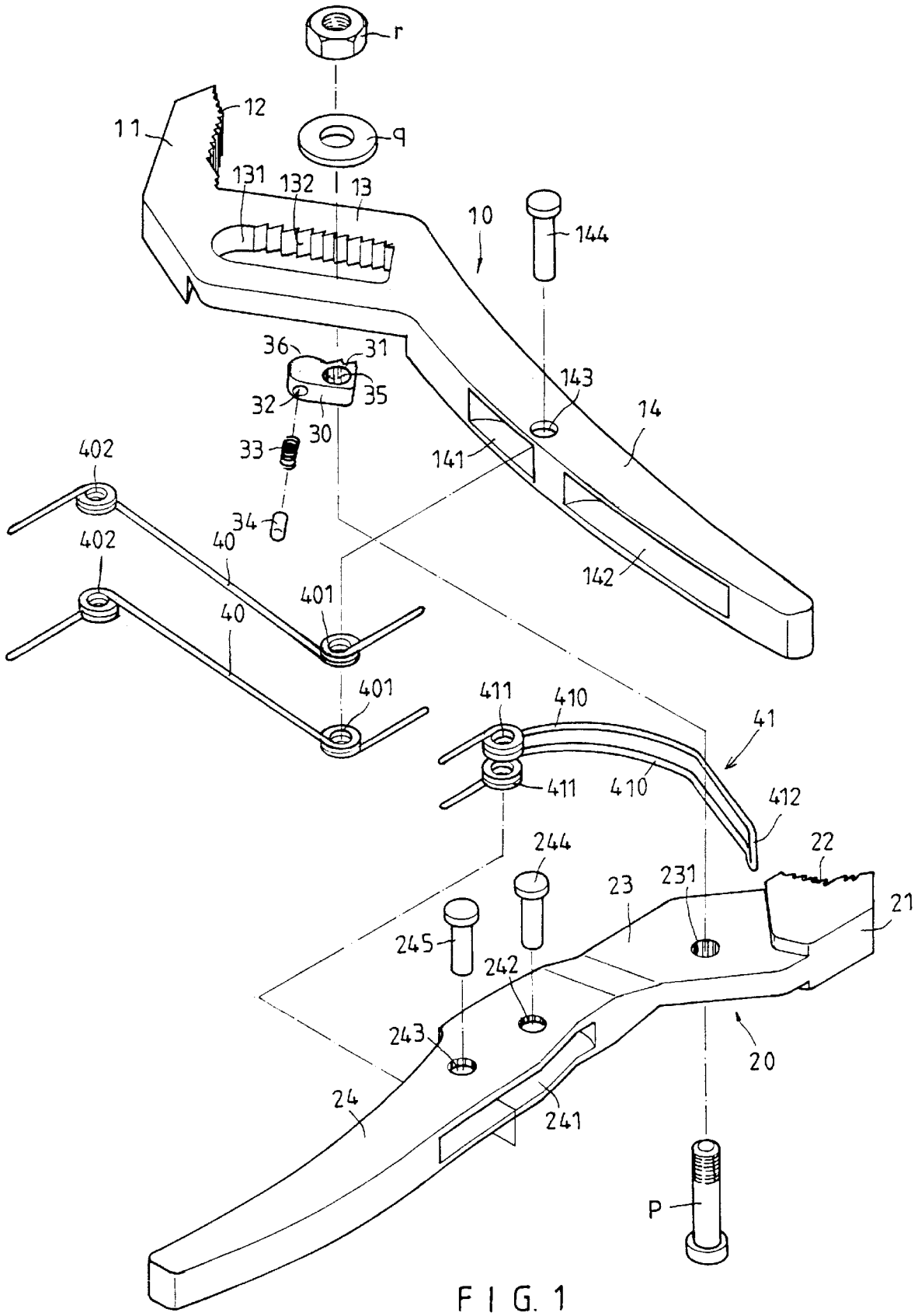
FIG. 1 is a perspective exploded view of a pair of pliers of a preferred embodiment in accordance with the present invention.
Figure 2A:
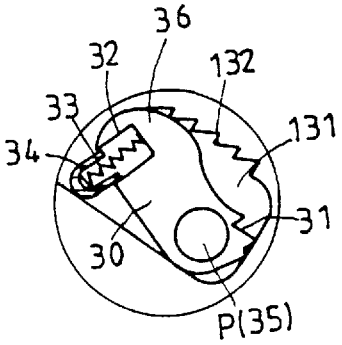
FIG. 2A is a partially enlarged view of a block plate and an oblong hole.
Figure 2:
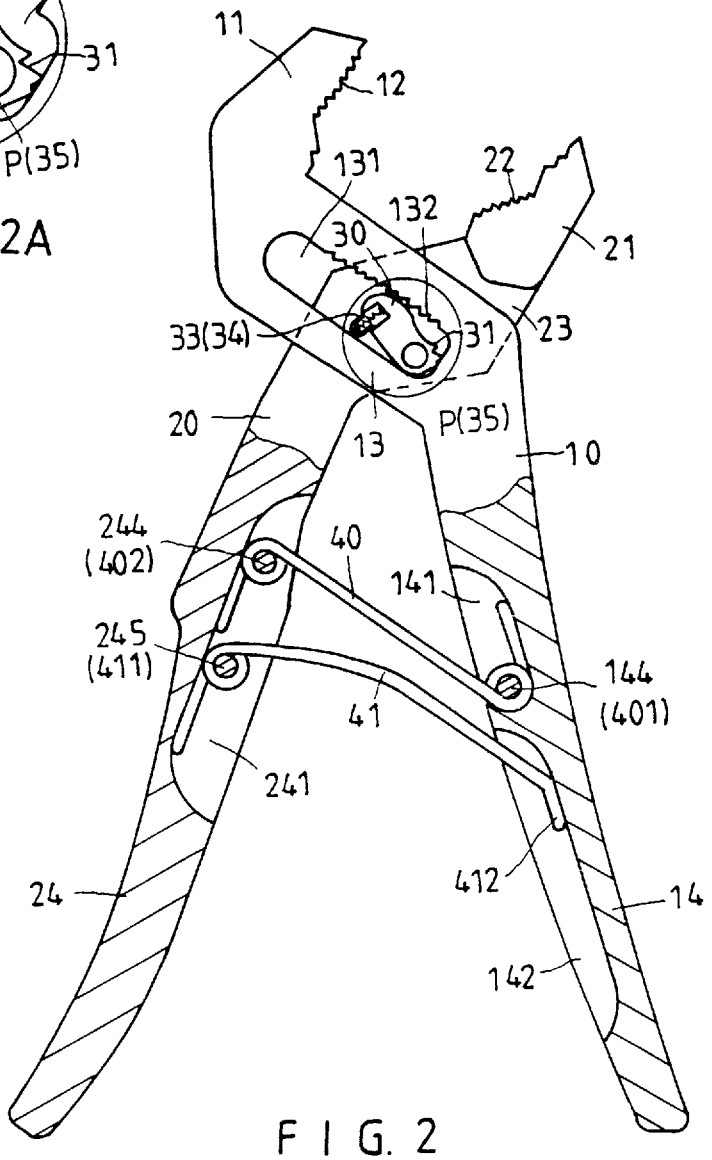
FIG. 2 is a schematic view of a pair of pliers of a preferred embodiment while a pair of pliers does not hold an article.

Referring to FIGS. 1 to 2A first, a pair of pliers comprises a driving handle 10, a fixed handle 20, a block plate 30, a U-shaped spring 41, a first torsion rod spring 40, and a second torsion rod spring 40.

The driving handle 10 has a first front jaw 11, a plurality of first serrated teeth 12 formed on an inner lateral of the first front jaw 11, a first rear grip portion 14, a first lever portion 13 between the first front jaw 11 and the first rear grip portion 14, an oblong hole 131 formed on the first lever portion 13, a plurality of serrations 132 formed in the oblong hole 131, a round through hole 143 formed on the first rear grip portion 14, a first recess slot 141 formed on the first rear grip portion 14, and a second recess slot 142 formed on the first rear grip portion 14.

The fixed handle 20 has a second front jaw 21, a second serrated teeth 22 formed on an inner lateral of the second front jaw 21, a second rear grip portion 24, a second lever portion 23 between the second front jaw 11 and the second rear grip portion 24, a circular hole 231 formed on the second lever portion 23, a first circular through hole 242 formed on the second rear grip portion 24, a second circular through hole 243 formed on the second rear grip portion 24, and a curved recess slot 241 formed on the second rear grip portion 24.

The first torsion rod spring 40 has a first distal end 401 and a second distal end 402. The first distal end 401 matches the round through hole 143. The second distal end 402 matches the first circular through hole 242.

The second torsion rod spring 40 has a third distal end 401 and a fourth distal end 402. The third distal end 401 matches the round through hole 143. The fourth distal end 402 matches the first circular through hole 242.

The U-shaped spring 41 has a first arm 410, a second arm 410, and a link portion 412 between the first arm 410 and the second arm 410. The first arm 410 has a first torsion spring end 411. The second arm 410 has a second torsion spring end 411. The link portion 412 is inserted in the second recess slot 142. The first torsion spring end 411 and the second torsion spring end 411 matches the second circular through hole 243.

The block plate 30 has two teeth 31, a round hole 35, an aperture 32, and a camber portion 36. The block plate 30 is inserted in the oblong hole 131. A compression spring 33 and a post 34 are inserted in the aperture 32. The round hole 35 matches the circular hole 231. A bolt p passes through the circular hole 231, the round hole 35, a cushion q, and a nut r.

A first pin 144 passes through the round through hole 143, the first distal end 401, and the third distal end 401. A second pin 244 passes through the first circular through hole 242, the second distal end 402 and the fourth distal end 402. The third pin 245 passes through the second circular through hole 243, the first torsion spring end 411, and the second torsion spring end 411.

Figure 3A:
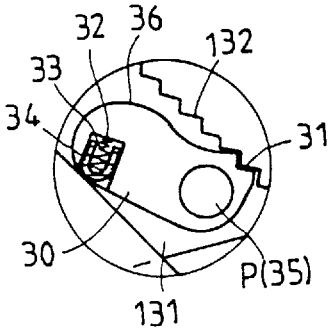
FIG. 3A is another partially enlarged view of a block plate and an oblong hole.
Figure 3:
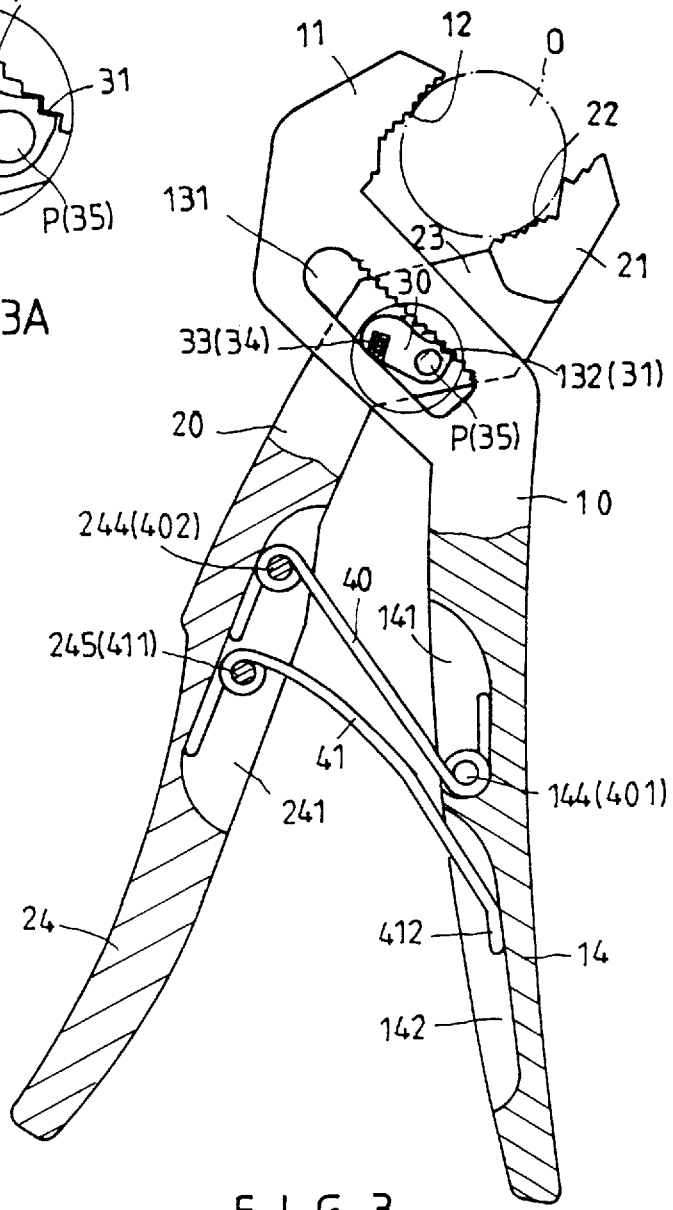
FIG. 3 is a schematic view of a pair of pliers of a preferred embodiment while a pair of pliers holds an article.

Referring to FIGS. 3 and 3A, the teeth 31 engage with the serrations 132 while the driving handle 10 and the fixed handle 20 are pressed. The first front jaw 11 and the second front jaw 21 can clamp an object O.

Referring to FIGS. 2 and 2A again, the teeth 31 disengage from the serrations 132 while the driving handle 10 and the fixed handle 20 are released.

The invention is not limited to the above embodiment but various modification thereof may be made. It will be understood by those skilled in the art that various changes in form and detail may be made without departing from the scope of the invention.

I claim:

1. A pair of pliers comprises:

a driving handle having a first front jaw, a plurality of first serrated teeth formed on an inner lateral of the first front jaw, a first rear grip portion, a first lever portion between the first front jaw and the first rear grip portion, an oblong hole formed on the first lever portion, a plurality of serrations formed in the oblong hole, a round through hole formed on the first rear grip portion, a first recess slot formed on the first rear grip portion, and a second recess slot formed on the first rear grip portion, a fixed handle having a second front jaw, a second serrated teeth formed on an inner lateral of the second front jaw, a second rear grip portion, a second lever portion between the second front jaw and the second rear grip portion, a circular hole formed on the second lever portion, a first circular through hole formed on the second rear grip portion, a second circular through hole formed on the second rear grip portion, and a curved recess slot formed on the second rear grip portion, a first torsion rod spring having a first distal end and a second distal end, the first distal end matching the round through hole, the second distal end matching the first circular through hole, a second torsion rod spring having a third distal end and a fourth distal end, the third distal end matching the round through hole, the fourth distal end matching the first circular through hole, a U-shaped spring having a first arm, a second arm, and a link portion between the first arm and the second arm, the first arm having a first torsion spring end, the second arm having a second torsion spring end, the link portion inserted in the second recess slot, the first torsion spring end and the second torsion spring end matching the second circular through hole, a block plate having two teeth, a round hole, an aperture, and a camber portion, the block plate inserted in the oblong hole, a compression spring and a post inserted in the aperture, the round hole matching the circular hole, a bolt passing through the circular hole, the round hole, a cushion, and a nut, a first pin passing through the round through hole, the first distal end, and the third distal end, a second pin passing through the first circular through hole, the second distal end and the fourth distal end, and the third pin passing through the second circular through hole, the first torsion spring end, and the second torsion spring end.

2. A pair of pliers as claimed in claim 1, wherein the teeth engage with the serrations.

* * * * *